US012083569B2

(12) United States Patent
Sue et al.

(10) Patent No.: US 12,083,569 B2
(45) Date of Patent: Sep. 10, 2024

(54) MEANDERING CONTROL METHOD FOR HOT-ROLLED STEEL STRIP, MEANDERING CONTROL DEVICE, AND HOT ROLLING EQUIPMENT

(71) Applicant: JFE Steel Corporation, Tokyo (JP)

(72) Inventors: Tatsuhiro Sue, Tokyo (JP); Yukio Takashima, Tokyo (JP); Hiroto Goto, Tokyo (JP); Hideto Yamaguchi, Tokyo (JP); Shohei Nishi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 332 days.

(21) Appl. No.: 17/617,631

(22) PCT Filed: Jun. 11, 2020

(86) PCT No.: PCT/JP2020/023098
§ 371 (c)(1),
(2) Date: Dec. 9, 2021

(87) PCT Pub. No.: WO2020/255863
PCT Pub. Date: Dec. 24, 2020

(65) Prior Publication Data

US 2022/0241832 A1 Aug. 4, 2022

(30) Foreign Application Priority Data

Jun. 20, 2019 (JP) ..... 2019-114684
May 14, 2020 (JP) ..... 2020-085279

(51) Int. Cl.
*B21B 37/68* (2006.01)
*B21B 1/26* (2006.01)
*B21B 37/58* (2006.01)

(52) U.S. Cl.
CPC ..... *B21B 37/68* (2013.01); *B21B 1/26* (2013.01)

(58) Field of Classification Search
CPC ..... B21B 37/68; B21B 37/58; B21B 1/26; B21B 2271/02; B21B 2015/0071;
(Continued)

(56) References Cited

U.S. PATENT DOCUMENTS 7,481,090 B2 * 1/2009 Ogawa ..... B21B 37/30 72/10.4
2010/0095722 A1 4/2010 Nishiura et al.
(Continued)

FOREIGN PATENT DOCUMENTS

CN 101013023 A 8/2007
CN 101622082 A 1/2010
(Continued)

OTHER PUBLICATIONS

English translate (WO1995007776A1), retrieved date Dec. 17, 2023.*
(Continued)

*Primary Examiner* — Mohammed S. Alawadi
(74) *Attorney, Agent, or Firm* — DLA Piper LLP (US)

(57) ABSTRACT

A meandering control device and hot rolling equipment suppress a meandering amount of a hot-rolled steel strip. A roll opening degree difference between an operation side and a driving side in an i-th rolling machine computed in a leveling control computation step (step S3) in the meandering control method, satisfies the roll opening degree difference between the operation side and the driving side in the i-th rolling machine (Fi) by Expressions (1), (2), and (3) in a control section j, in a case where the control section j is set when a tail end portion (Sa) of a traveling hot-rolled steel strip (10) is present between a j-th (j≤i−1) rolling machine (Fj) and a (j+1)th rolling machine (Fj+1) counting from a rolling machine (F1) installed on a most upstream side.

18 Claims, 5 Drawing Sheets

(58) Field of Classification Search
CPC ..... B21B 38/08; B21B 38/12; B21B 2273/04; B21B 2256/12
USPC ..... 72/10.4, 6.1–14.7
See application file for complete search history.

(56) References Cited

U.S. PATENT DOCUMENTS

| | | | | |
|---|---|---|---|---|
| 2010/0242566 | A1 | 9/2010 | Weisshaar | |
| 2015/0082848 | A1* | 3/2015 | Ito | B21B 38/00 72/31.07 |

FOREIGN PATENT DOCUMENTS

| | | | | | |
|---|---|---|---|---|---|
| CN | 101801553 | A | | 8/2010 | |
| CN | 102728625 | A | | 10/2012 | |
| CN | 103252358 | A | | 8/2013 | |
| DE | 38 37 101 | A1 | | 5/1990 | |
| DE | 10 2008 007247 | A1 | | 3/2009 | |
| JP | H1-205808 | A | | 8/1989 | |
| JP | H7-144211 | A | | 6/1995 | |
| JP | 2005-156420 | A | | 6/2005 | |
| JP | 2006-150414 | A | | 6/2006 | |
| JP | 2013-212523 | A | | 10/2013 | |
| KR | 10-2004-0033106 | A | | 4/2004 | |
| KR | 10-2010-0069826 | A | | 6/2010 | |
| WO | WO-9101827 | A | * | 2/1991 | B21B 37/68 |
| WO | WO-9507776 | A1 | * | 3/1995 | B21B 37/68 |
| WO | 2018/216215 | A1 | | 11/2018 | |

OTHER PUBLICATIONS

English translate (WO9101827A1), retrieved date Dec. 17, 2023.*
Office Action dated Jun. 27, 2023, of counterpart Korean Patent Application No. 10-2022-7001580, along with a Concise Statement of Relevance of Office Action in English.
Extended European Search Report dated Jul. 21, 2022, of counterpart European Patent Application No. 20844736.7.
First Office Action dated Mar. 9, 2023, of counterpart Chinese Patent Application No. 202080052053.1, along with an English machine translation.
Ceracki et al, "On-line Surface Inspection of Hot Rolled Strip," Stahl and Eisen, vol. 119, Issue 4, pp. 77-81, 1999, Abstract only in English.
Peiponen et al, "Optical Measurement Techniques," Innovations for Industry and the Life Sciences, 1st Edition, pp. 72 and 73, 2016, Abstract only.
The English Translation of the International Preliminary Report on Patentability and Written Opinion dated Dec. 30, 2021.

* cited by examiner

MEANDERING CONTROL METHOD FOR HOT-ROLLED STEEL STRIP, MEANDERING CONTROL DEVICE, AND HOT ROLLING EQUIPMENT

TECHNICAL FIELD

This disclosure relates to a meandering control method for a hot-rolled steel strip, a meandering control device, and hot rolling equipment.

BACKGROUND

In general, in a manufacturing line (hot strip mill) for a hot-rolled steel strip, a heated slab goes through a manufacturing process such as a rough rolling process or a finish rolling process to manufacture a steel sheet having a predetermined sheet width and sheet thickness.

In the finish rolling process, as illustrated in FIG. 5, tandem rolling is performed in which a hot-rolled steel strip (hereinafter a steel strip) 10 is simultaneously finish-rolled in finish rolling equipment 1 configured with a plurality of (for example, seven) rolling machines F1 to F7 to manufacture a steel sheet having a predetermined sheet thickness.

In tandem rolling, as illustrated in FIG. 6, a phenomenon, which is called meandering, may occur in which the steel strip 10 moves in a width direction due to a sheet thickness distribution of the steel strip 10 in the width direction, a temperature difference of the steel strip 10 in the width direction, and bending of the steel strip 10 in the width direction. A distance from a center CL1 of each of the rolling machines F1 to F7 in the width direction (the same direction as the width direction of the steel strip 10) to CL2 of the steel strip 10 in the width direction is called a meandering amount 6. When the steel strip 10 meanders to an operation side of each of the rolling machines F1 to F7 is defined as "+," and when the steel strip 10 meanders to a driving side of each of the rolling machines F1 to F7 is defined as "−." The driving side of each of the rolling machines F1 to F7 represents a side connected to a motor (not illustrated) of a conveying roll (not illustrated), and the operation side of each of the rolling machines F1 to F7 represents an opposite side of the driving side in the width direction. The arrows in FIGS. 5 and 6 indicate an advancing direction of the steel strip 10 during rolling.

When meandering of a tail end portion 10*a* of the steel strip 10 becomes large, a trouble may occur, which is called squeezing in which the steel strip 10 comes into contact with a guide that restrains the steel strip 10 in the width direction, the steel strip 10 is folded, and the steel strip 10 is rolled in this state. When squeezing occurs, work rolls 1*a* (refer to FIG. 5) of each of the rolling machines F1 to F7 for rolling the steel strip 10 are flawed and the rolls need to be replaced. It is necessary to temporarily stop the work to replace the roll, and when the squeezing frequently occurs, the downtime will be large. Therefore, reducing the meandering of the steel strip 10 and suppressing the occurrence of squeezing is an important issue in tandem rolling of the hot-rolled steel strip.

One of the methods of preventing the meandering of the steel strip is a method of changing a leveling amount of the rolling machine. The leveling amount is an opening degree difference of roll gaps between the operation side and the driving side of the rolling machine. When the opening degree of the roll gap on the operation side is large is defined as "+," and when the opening degree of the roll gap on the driving side is large is defined as "−."

For example, when the leveling amount of the rolling machine is changed to the + side during rolling, the rolling amount on the driving side is relatively larger than that on the operation side, and thus, the steel strip on the driving side is longer than that on the operation side, and the steel strip meanders to the operation side on an exit side of the rolling machine. On the contrary, when the leveling amount of the rolling machine is changed to the—side during rolling, the rolling amount on the operation side is relatively larger than that on the driving side, and thus, the steel strip on the operation side is longer than that on the driving side, and the steel strip meanders to the driving side on the exit side of the rolling machine.

As a method of preventing meandering of a steel strip by changing the leveling amount, for example, methods described in JP H7-144211 A and JP 2013-212523 A have been suggested.

The steel sheet tail end meandering control method in hot finish rolling described in JP '211 is a method in which, in tandem rolling, a meandering detection device is installed substantially at the center between stands to perform meandering control, and after a tail end of a rolling material passes through the meandering detection device, high-response and stable control is achieved by performing meandering control by a differential load type, and sensor type meandering control is possible even with a low temperature material.

Further, a meandering control method for a rolled material described in JP '523 implements "sensor type meandering control" by performing feedback control with a second control gain lower than a first control gain when a tail end of the rolled material passes through a rolling stand F5. Further, "sensor type meandering control" is implemented by performing the feedback control with the first control gain when the tail end of the rolled material passes through a rolling stand F6, and "differential load type meandering control" is implemented by performing the feedback control with a fourth control gain lower than a third control gain. Furthermore, when the tail end of the rolled material passes through a meandering amount detection sensor, the "sensor type meandering control" is terminated, and the "differential load type meandering control" is implemented by performing the feedback control with the third control gain. Further, when the tail end of the rolled material passes through a rolling stand F7, the "differential load type meandering control" is terminated.

However, the steel sheet tail end meandering control method in the hot finish rolling described in JP '211 and the meandering control method for the rolled material described in JP '523 of the related art have the following problems.

In the steel sheet tail end meandering control method in the hot finish rolling illustrated in JP '211, it may occur in which a control target is switched (switching from the "sensor type meandering control" to the "differential load type meandering control") when the rolling material tail end has passed through the meandering detection device, and the consistency is not obtained, and not only is the effect of suppressing the meandering amount of the steel strip not sufficiently exhibited, but on the contrary, the meandering amount may increase.

Further, in the meandering control method for the rolled material described in JP '523, a method is employed in which a control gain is gradually reduced at any point between the stands, but the meandering phenomenon is a divergence phenomenon, and the effect of suppressing the meandering amount may not be sufficiently exhibited as the control gain deteriorates.

Therefore, it could be helpful to provide a meandering control method for a hot-rolled steel strip, a meandering control device, and hot rolling equipment capable of sufficiently suppressing a meandering amount of the hot-rolled steel strip during finish rolling.

SUMMARY

We provide a meandering control method for a hot-rolled steel strip, the method being for controlling meandering of the hot-rolled steel strip rolled in finish rolling equipment including n ($n \geq 3$) rolling machines each having a load detector configured to detect rolling loads on an operation side and a driving side and a leveling device configured to adjust rolling amounts on the operation side and the driving side, the method including: a meandering amount measurement step of measuring a meandering amount of a traveling hot-rolled steel strip by a meandering amount measuring device installed between an i-th ($i \leq n$) rolling machine and an (i−1)th rolling machine counting from a rolling machine installed on a most upstream side; a differential load detection step of detecting a differential load between the operation side and the driving side from the rolling loads on the operation side and the driving side detected by the load detector provided in the i-th rolling machine; and a leveling control computation step of computing a roll opening degree difference based on the meandering amount of the hot-rolled steel strip measured in the meandering amount measurement step and the differential load detected in the differential load detection step, the roll opening degree difference being an opening degree difference of roll gaps between the operation side and the driving side in the i-th rolling machine, and sending the computed roll opening degree difference to the leveling device provided in the i-th rolling machine, in which the roll opening degree difference computed in the leveling control computation step, the roll opening degree difference being the opening degree difference of the roll gaps between the operation side and the driving side in the i-th rolling machine, satisfies the roll opening degree difference between the operation side and the driving side in the i-th rolling machine by Expressions (1), (2), and (3) in a control section j, when the control section j is set when a tail end portion of the traveling hot-rolled steel strip is present between a j-th ($j \leq i-1$) rolling machine and a (j+1)th rolling machine counting from the rolling machine installed on the most upstream side:

$$S=\alpha_j C(\delta-\delta_j)+\beta_j D(\Delta P-\Delta P_j)+S_j \quad (1)$$

$$0 \leq \alpha_1 \leq \alpha_2 \leq \ldots \leq \alpha_j \leq \ldots \leq \alpha_{i-1} \quad (2)$$

$$0 \leq \beta_1 \leq \beta_2 \leq \ldots \leq \beta_j \leq \ldots \leq \beta_{i-1} \quad (3)$$

wherein S is the roll opening degree difference between the operation side and the driving side in the i-th rolling machine, $S_j$ is the roll opening degree difference between the operation side and the driving side in the i-th rolling machine when the tail end portion of the hot-rolled steel strip has passed through the j-th rolling machine, $\alpha_j$ is a control gain with respect to the meandering amount measured by the meandering amount measuring device, in the control section j, $\beta_j$ is a control gain with respect to the differential load detected from the load detector provided in the i-th rolling machine, in the control section j, $\delta_j$ is the meandering amount measured by the meandering amount measuring device when the tail end portion of the hot-rolled steel strip has passed through the j-th rolling machine, $\Delta P_j$ is the differential load detected from the load detector provided in the i-th rolling machine when the tail end portion of the hot-rolled steel strip has passed through the j-th rolling machine, δ is the meandering amount measured by the meandering amount measuring device, in the control section j, ΔP is the differential load detected from the load detector provided in the i-th rolling machine, in the control section j, C is a change amount of a leveling amount with respect to the meandering amount, and D is a constant determined by a roll diameter, a roll length, the number of rolls, a width of a rolling material, and the like.

The driving side in the rolling machine means a side where a driving motor is present, and the operation side means an opposite side thereof.

We also provide a meandering control device for a hot-rolled steel strip, the device being configured to control meandering of the hot-rolled steel strip rolled in finish rolling equipment including n ($n \geq 3$) rolling machines each having a load detector configured to detect rolling loads on an operation side and a driving side and a leveling device configured to adjust rolling amounts on the operation side and the driving side, the device including: a meandering amount measuring device installed between an i-th ($i \leq n$) rolling machine and an (i−1)th rolling machine counting from a rolling machine installed on a most upstream side, and configured to measure a meandering amount of a traveling hot-rolled steel strip; and a leveling control computing device configured to compute a roll opening degree difference based on the meandering amount of the hot-rolled steel strip measured by the meandering amount measuring device and a differential load between the operation side and the driving side detected from the rolling loads on the operation side and the driving side detected by the load detector provided in the i-th rolling machine, the roll opening degree difference being an opening degree difference of roll gaps between the operation side and the driving side in the i-th rolling machine, and to send the computed roll opening degree difference to the leveling device provided in the i-th rolling machine, in which the roll opening degree difference computed by the leveling control computing device, the roll opening degree difference being the opening degree difference of the roll gaps between the operation side and the driving side in the i-th rolling machine, satisfies the roll opening degree difference between the operation side and the driving side in the i-th rolling machine by Expressions (1), (2), and (3) in a control section j, when the control section j is set when a tail end portion of the traveling hot-rolled steel strip is present between a j-th ($j \leq i-1$) rolling machine and a (j+1)th rolling machine counting from the rolling machine installed on the most upstream side:

$$S=\alpha_j C(\delta-\delta_j)+\beta_j D(\Delta P-\Delta P_j)+S_j \quad (1)$$

$$0 \leq \alpha_1 \leq \alpha_2 \leq \ldots \leq \alpha_j \leq \ldots \leq \alpha_{i-1} \quad (2)$$

$$0 \leq \beta_1 \leq \beta_2 \leq \ldots \leq \beta_j \leq \ldots \leq \beta_{i-1} \quad (3)$$

wherein S is the roll opening degree difference between the operation side and the driving side in the i-th rolling machine, $S_j$ is the roll opening degree difference between the operation side and the driving side in the i-th rolling machine when the tail end portion of the hot-rolled steel strip has passed through the j-th rolling machine, $\alpha_j$ is a control gain with respect to the meandering amount measured by the meandering amount measuring device, in the control section j, $\beta_j$ is a control gain with respect to the differential load detected from the load detector provided in the i-th rolling machine, in the control section j, $\delta_j$ is the meandering amount measured by the meandering amount measuring device when the tail end portion of the hot-rolled steel strip has passed through the j-th rolling machine, $\Delta P_j$ is the differential load detected from the load detector provided in the i-th rolling machine when the tail end portion of the hot-rolled steel strip has passed through the j-th rolling machine, $\delta$ is the meandering amount measured by the meandering amount measuring device, in the control section j, $\Delta P$ is the differential load detected from the load detector provided in the i-th rolling machine, in the control section j, C is a change amount of a leveling amount with respect to the meandering amount, and D is a constant determined by a roll diameter, a roll length, the number of rolls, a width of a rolling material, and the like.

We further provide hot rolling equipment including: the above-described meandering control device for a hot-rolled steel strip.

According to the meandering control method for a hot-rolled steel strip, the meandering control device, and the hot rolling equipment, it is possible to provide a meandering control method for a hot-rolled steel strip, a meandering control device, and hot rolling equipment capable of sufficiently suppressing the meandering amount of the hot-rolled steel strip during finish rolling.

REFERENCE SIGNS LIST

Figure 1:
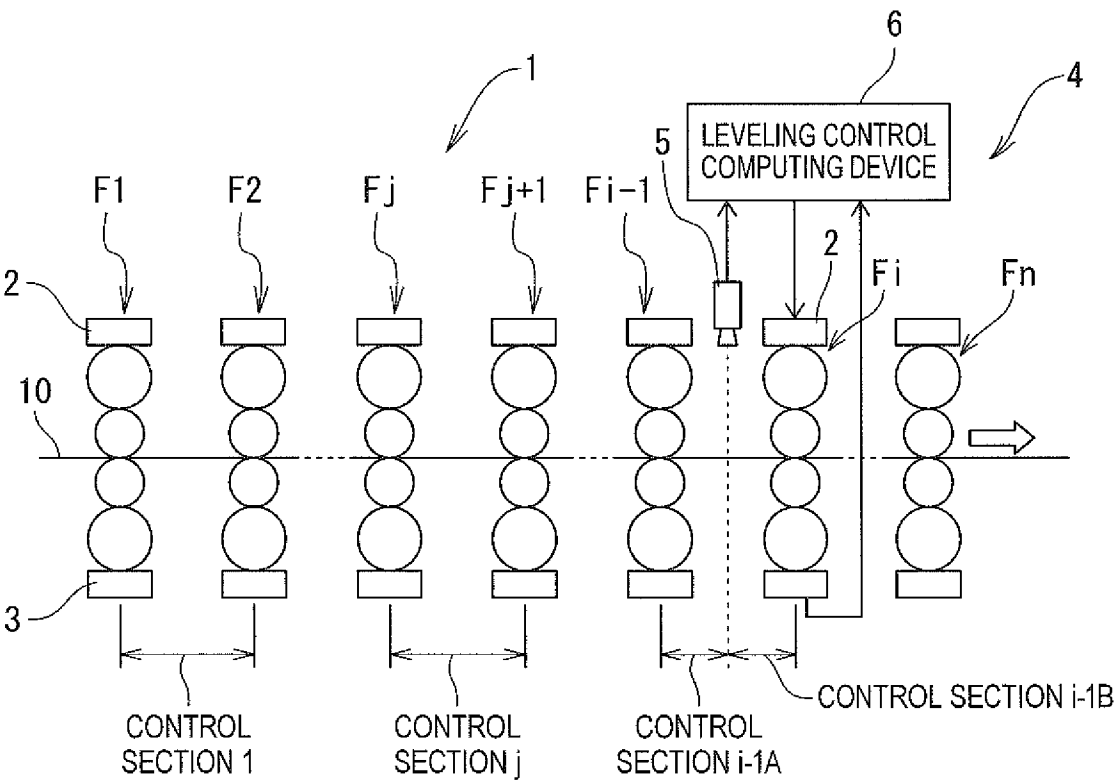
FIG. 1 is a schematic configuration view of finish rolling equipment to which a meandering control device according to an example is applied.

1 finish rolling equipment
2 leveling device
3 load detector
4 meandering control device
5 meandering amount measuring device
5*a* edge position detecting device
5*b* infrared camera
5*c* edge position detection unit
5*d* meandering amount calculating device
6 leveling control computing device
10 hot-rolled steel strip
10*a* tail end portion
F1 to Fn rolling machine

DETAILED DESCRIPTION

Hereinafter, examples of our methods, devices and equipment will be described with reference to the drawings. The examples described below exemplify devices and methods embodying the technical idea of our methods, devices and equipment, and the technical idea does not specify the material, shape, structure, arrangement and the like of the configuration components in the following examples. The drawings are schematic. Therefore, the relationship, ratio, and the like between the thickness and the plane dimension are different from the actual ones, and there are parts where the relationship or ratio of the dimensions are different between the drawings.

FIG. 1 illustrates a schematic configuration of finish rolling equipment to which a meandering control device according to an example is applied.

In hot rolling equipment of a hot-rolled steel strip, a slab heated in a heating furnace (not illustrated) goes through a rough rolling process, a finish rolling process, and a cooling process to manufacture and wind a steel sheet having a predetermined sheet width and sheet thickness. In other words, the hot rolling equipment includes the heating furnace, rough rolling equipment (not illustrated), finish rolling equipment 1 (refer to FIG. 1), cooling equipment (not illustrated), and winding equipment (not illustrated).

In the finish rolling process, tandem rolling is performed in which a hot-rolled steel strip (hereinafter, simply referred to as a steel strip) 10 is finish-rolled at the same time in the finish rolling equipment 1 illustrated in FIG. 1. The finish rolling equipment 1 includes n ($n \geq 3$) rolling machines F1 to Fn for finish-rolling the steel strip 10. Each of the rolling machines F1 to Fn is provided with a leveling device 2 for adjusting rolling amounts on an operation side and a driving side, and a load detector 3 for detecting rolling loads on the operation side and the driving side.

Each of the leveling devices 2 adjusts a rolling amount by a rolling device (not illustrated) attached to the operation side of each of the rolling machines F1 to Fn, and a rolling amount by a rolling device (not illustrated) attached to the driving side of each of the rolling machines F1 to Fn.

Further, the load detector 3 is attached to both the operation side and the driving side of each of the rolling machines F1 to Fn to detect a rolling load of each of the operation side and the driving side. A leveling control computing device 6 which will be described later detects a differential load which is a difference between the rolling load on the operation side and the rolling load on the driving side which are detected by the load detector 3.

The finish rolling equipment 1 is provided with a meandering control device 4 for controlling the meandering of the steel strip 10. The meandering control device 4 controls the meandering of the steel strip 10 by using both "meandering meter type meandering control" and "differential load type meandering control."

The "meandering meter type meandering control" changes a leveling amount (a roll opening degree difference which is an opening degree difference of roll gaps between the operation side and the driving side in the i-th rolling machine Fi) of a rolling machine Fi which is a control target that is in the vicinity of a downstream side of a position where a meandering amount measuring device 5 (will be described later) is installed, to be proportional to the meandering amount measured by the meandering amount measuring device 5. When the meandering of the steel strip 10 occurs on the operation side, the leveling amount is changed to close the operation side (to the "−" side), and when the meandering of the steel strip 10 occurs on the driving side, the leveling amount is changed to close the driving side (to the "+" side).

The "differential load type meandering control" changes the leveling amount (a roll opening degree difference which is an opening degree difference of roll gaps between the operation side and the driving side in the i-th rolling machine Fi) of the rolling machine Fi which is a control target, to be proportional to the differential load between the operation side and the driving side which is detected from the load detector 3 provided in the rolling machine Fi. When the rolling load on the operation side is larger than the rolling load on the driving side, the differential load is "+," and when the rolling load on the driving side is larger than the rolling load on the operation side, the differential load is "−." When there is no sheet thickness deviation in the width direction and no temperature difference in the width direction in the steel strip 10, when the steel strip 10 passes through the center of the rolling machines F1 to Fn, no differential load is generated. Then, when the meandering of the steel strip 10 occurs on the operation side, the differential load becomes "+," and when the meandering of the steel strip 10 occurs on the driving side, the differential load becomes "−." In this "differential load type meandering control," when the differential load is "+," the leveling amount is changed to close the operation side, and when the differential load is "−," the leveling amount is changed to close the driving side.

The meandering control device 4 controls the meandering of the steel strip 10 by using both the "meandering meter type meandering control" and the "differential load type meandering control" in combination, and includes the meandering amount measuring device 5 which is installed between the i-th (i≤n) rolling machine Fi and the (i−1)th rolling machine Fi−1 counting from the rolling machine F1 installed on the most upstream side, and measures the meandering amount of the traveling steel strip 10. The meandering amount measuring device 5 is configured with a visible light camera (one-dimensional camera or two-dimensional camera) and, for example, measures the brightness distribution in the width direction of the steel strip 10 and calculates the meandering amount from the brightness distribution.

The meandering control device 4 includes the leveling control computing device 6 that computes the roll opening degree difference which is an opening degree difference of roll gaps between the operation side and the driving side in the i-th rolling machine Fi based on the meandering amount of the steel strip 10 measured by the meandering amount measuring device 5 and the differential load between the operation side and the driving side which is detected from the rolling loads on the operation side and the driving side detected by the load detector 3 provided in the i-th rolling machine Fi, and sends the computed roll opening degree difference to the leveling device 2 provided in the i-th rolling machine Fi.

The leveling device 2 adjusts the rolling amount by the rolling device attached to the operation side of the rolling machine Fi which is the control target and the rolling amount by the rolling device attached to the driving side of the rolling machine Fi such that the roll opening degree difference of the rolling machine Fi which is the control target becomes the roll opening degree difference sent from the leveling control computing device 6, based on the roll opening degree difference sent from the leveling control computing device 6. Accordingly, the leveling amount of the rolling machine Fi which is the control target is changed to be proportional to the meandering amount of the steel strip 10 and the differential load of the rolling machine Fi, and the meandering amount of the steel strip 10 is suppressed.

Figure 5:
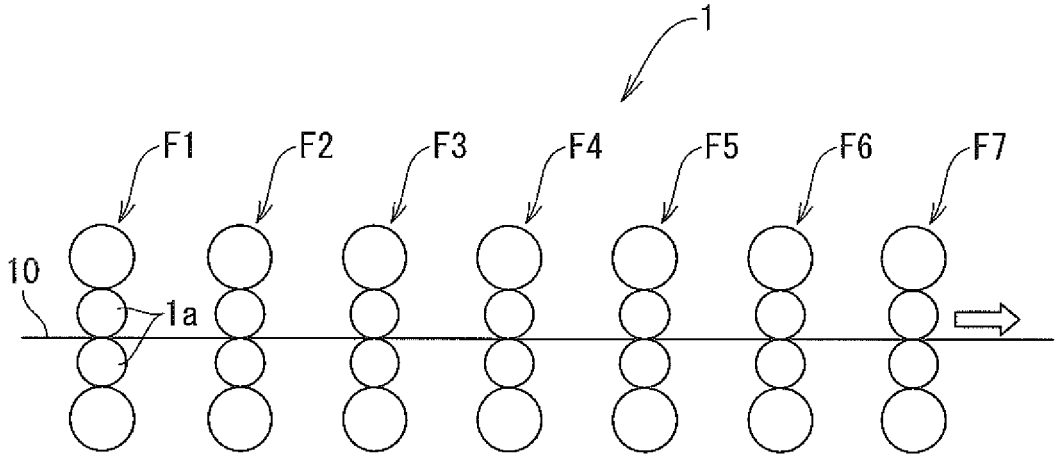
FIG. 5 is a schematic configuration view of general finish rolling equipment.
Figure 6:
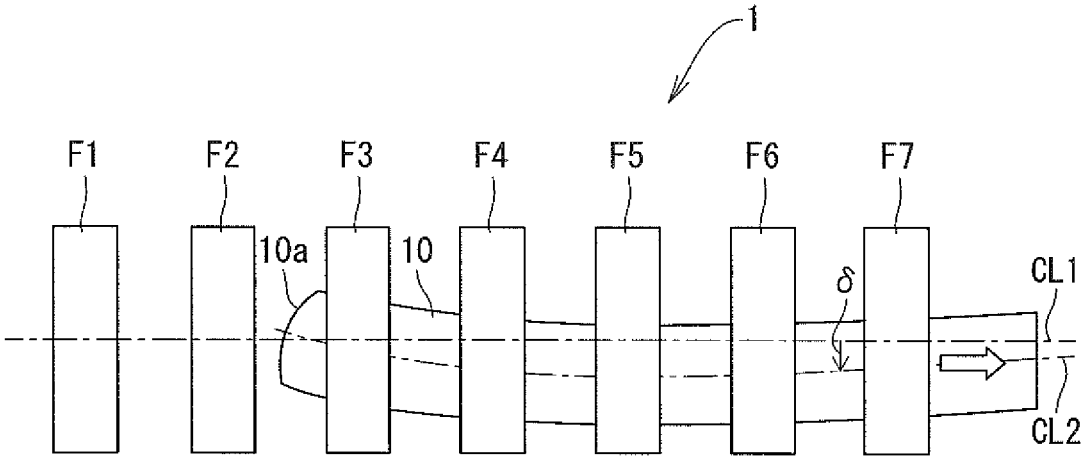
FIG. 6 is a schematic view describing a meandering phenomenon of a steel strip.

The roll opening degree difference between the operation side and the driving side in the i-th rolling machine Fi computed by the leveling control computing device 6 satisfies the roll opening degree difference between the operation side and the driving side in the i-th rolling machine Fi by Expressions (1), (2), and (3) in a control section j, when the control section j is set when a tail end portion 10*a* (refer to FIG. 5) of the traveling steel strip 10 is present between a j-th (j≤i−1) rolling machine Fj and a (j+1)th rolling machine Fj+1 counting from the rolling machine F1 installed on the most upstream side:

$$S=\alpha_j C(\delta-\delta_j)+\beta_j D(\Delta P-\Delta\beta P_j)+S_j \quad (1)$$

$$0\le\alpha_1\le\alpha_2\le\ldots\le\alpha_j\le\ldots\le\alpha_{i-1} \quad (2)$$

$$0\le\beta_1\le\beta_2\le\ldots\le\beta_j\le\ldots\le\beta_{i-1} \quad (3).$$

S is the roll opening degree difference between the operation side and the driving side in the i-th rolling machine Fi, $S_j$ is the roll opening degree difference between the operation side and the driving side in the i-th rolling machine when the tail end portion 10*a* of the steel strip 10 has passed through the j-th rolling machine Fj, $\alpha_j$ is a control gain with respect to the meandering amount measured by the meandering amount measuring device 5, in the control section j, $\beta_j$ is a control gain with respect to the differential load detected from the load detector 3 provided in the i-th rolling machine Fi, in the control section j, $\delta_j$ is the meandering amount measured by the meandering amount measuring device 5 when the tail end portion 10*a* of the steel strip 10 has passed through the j-th rolling machine Fj, $\Delta P_j$ is the differential load detected from the load detector 3 provided in the i-th rolling machine Fi when the tail end portion 10*a* of the steel strip 10 has passed through the j-th rolling machine Fj, δ is the meandering amount measured by the meandering amount measuring device 5, in the control section j, ΔP is the differential load detected from the load detector 3 provided in the i-th rolling machine Fi, in the control section j, C is a change amount of a leveling amount with respect to the meandering amount, and D is a constant determined by a roll diameter, a roll length, the number of rolls, a width of a rolling material, and the like.

When the tail end portion 10*a* of the steel strip 10 passes through the rolling machines F1 to Fn, the tension is lost, and thus, the meandering of the steel strip 10 tends to increase. The meandering tends to increase as the tail end portion 10*a* of the steel strip 10 passes through the rolling machine on the rear stage side. In the computation of the roll opening degree difference by the leveling control computing device 6, as illustrated in Expression (2), the control gain $\alpha_j$ with respect to the meandering amount measured by the meandering amount measuring device 5 in the control section j increases as the control section advances to the rear stage side, that is, as the tail end portion 10*a* of the steel strip 10 advances to the control section on the rear stage side. As illustrated in Expression (3), the control gain $\beta_j$ with respect to the differential load detected from the load detector 3 provided in the i-th rolling machine Fi in the control section j also increases as the control section advances to the rear stage side, that is, as the tail end portion 10*a* of the steel strip 10 advances to the control section on the rear stage side. Therefore, the control gains $\alpha_j$ and $\beta_j$ also increase in accordance with the tendency that the meandering increases as the tail end portion 10*a* of the steel strip 10 passes through the rolling machine on the rear stage side, and thus, it is possible to sufficiently suppress the meandering amount of the steel strip 10 during finish rolling.

Further, in a control section i−1 in which the meandering amount measuring device 5 is installed, the control section is further divided into a control section i−1A when the tail end portion 10*a* of the traveling steel strip 10 is present between the (i−1)th rolling machine Fi−1 and the meandering amount measuring device 5, and a control section i−1B when the tail end portion 10*a* is present between the meandering amount measuring device 5 and the i-th rolling machine Fi. The roll opening degree difference, which is the opening degree difference of the roll gaps between the operation side and the driving side in the i-th rolling machine computed by the leveling control computing device 6, satisfies the roll opening degree difference between the operation side and the driving side in the i-th rolling machine Fi by Expression (4) in the control section i−1A, and satisfies the roll opening degree difference between the operation side and the driving side in the i-th rolling machine Fi by Expression (5) in the control section i−1B:

$$S=\alpha_{i-1A}(\delta-\delta_{i-1})+\beta_{i-1A}D(\Delta P-\Delta P_{i-i})+S_{i-1} \quad (4).$$

S is the roll opening degree difference between the operation side and the driving side in the i-th rolling machine Fi, $S_{i-1}$ is the roll opening degree difference between the operation side and the driving side in the i-th rolling machine when the tail end portion 10*a* of the steel strip 10 has passed through the (i−1)th rolling machine Fi−1, $\alpha_{i-A}$ is a control gain with respect to the meandering amount measured by the meandering amount measuring device 5, in the control section i−1A, $\beta_{i-1A}$ is a control gain with respect to the differential load detected from the load detector 3 provided in the i-th rolling machine Fi, in the control section i−1A, $\delta_{i-1}$ is the meandering amount measured by the meandering amount measuring device 5 when the tail end portion 10*a* of the steel strip 10 has passed through the (i−1)th rolling machine Fi−1, $\Delta P_{i-1}$ is the differential load detected from the load detector 3 provided in the i-th rolling machine Fi when the tail end portion 10*a* of the steel strip 10 has passed through the (i−1)th rolling machine Fi−1, δ is the meandering amount measured by the meandering amount measuring device 5, in the control section i−1A, ΔP is the differential load detected from the load detector 3 provided in the i-th rolling machine Fi, in the control section i−1A, C is a change amount of a leveling amount with respect to the meandering amount, and D is a constant determined by a roll diameter, a roll length, the number of rolls, a width of a rolling material, and the like.

In the control section i−1B, since the tail end portion 10*a* of the steel strip 10 has passed through the meandering amount measuring device 5, the meandering amount of the steel strip 10 cannot be measured, and thus, only the "differential load type meandering control" is performed.

$$S=\beta_{i-B}D(\Delta P-\Delta P_{i-1B})+S_{i-1B} \quad (5)$$

S is the roll opening degree difference between the operation side and the driving side in the i-th rolling machine Fi, $S_{i-1B}$ is the roll opening degree difference between the operation side and the driving side in the i-th rolling machine when the tail end portion 10*a* of the steel strip 10 has passed through the meandering amount measuring device 5, $\beta_{i-1B}$ is a control gain with respect to the differential load detected from the load detector 3 provided in the i-th rolling machine Fi, in the control section i−1B, $\Delta P_{i-1B}$ is the differential load detected from the load detector 3 provided in the i-th rolling machine Fi when the tail end portion 10*a* of the steel strip 10 has passed through the meandering amount measuring device 5, ΔP is the differential load detected from the load detector 3 provided in the i-th rolling machine Fi, in the control section i−1B, and D is a constant determined by a roll diameter, a roll length, the number of rolls, a width of a rolling material, and the like.

In this manner, in the control section i−1 in which the meandering amount measuring device 5 is installed, it is possible to obtain a higher meandering suppression effect by changing the control target and the control gain before and after the tail end portion 10*a* of the steel strip 10 passes through the meandering amount measuring device 5.

Before the tail end portion 10*a* of the steel strip 10 passes through the meandering amount measuring device 5 (control section i−1A), the meandering of the steel strip 10 is controlled by using both the "meandering meter type meandering control" and the "differential load type meandering control" in combination, and the meandering amount and the differential load when passing through the (i−1)th rolling machine Fi−1 are set as control targets. Further, after the tail end portion 10*a* of the steel strip 10 has passed through the meandering amount measuring device 5 (control section i−1B), the meandering of the steel strip 10 is controlled only by the "differential load type meandering control," and the differential load when passing through the meandering amount measuring device 5 is set as the control target. When the meandering amount of the steel strip 10 is reduced in the control section i−1A, the differential load when passing through the meandering amount measuring device 5 is reduced. When the control target in the control section i−1B is not changed to the differential load when passing through the meandering amount measuring device 5 and remains to be the differential load when passing through the (i−1)th rolling machine Fi−1, there is a possibility that the meandering of the steel strip 10 is controlled in a direction in which the meandering increases. Therefore, the control target in the control section i−1B was switched from the differential load when passing through the (i−1)th rolling machine Fi−1 to the differential load when passing through the meandering amount measuring device 5.

Next, the flow of the process by the meandering control device 4 will be described with reference to the flowchart illustrated in FIG. 2.

First, when the finish rolling of the steel strip 10 is started and the tip end portion of the steel strip 10 passes through the rolling machine Fi which is a control target, in step S1, the meandering amount measuring device 5 installed between the i-th (i≤n) rolling machine Fi and the (i−1)th rolling machine Fi−1 counting from the rolling machine F1 installed on the most upstream side measures the meandering amount of the traveling steel strip 10 (meandering amount measurement step).

Next, the process proceeds to step S2, and the leveling control computing device 6 detects the differential load between the operation side and the driving side from the rolling loads on the operation side and the driving side which are detected by the load detector 3 provided in the i-th rolling machine Fi, which is the control target (differential load detection step).

Next, the process proceeds to step S3, and the leveling control computing device 6 computes the roll opening degree difference, which is an opening degree difference of roll gaps between the operation side and the driving side in the i-th rolling machine Fi, based on the meandering amount of the steel strip 10 measured in step S1 (meandering amount measurement step) and the differential load detected in step S2 (differential load detection step), and sends the computed roll opening degree difference to the leveling device 2 provided in the i-th rolling machine Fi (leveling control computation step).

The roll opening degree difference which is the opening degree difference of the roll gaps between the operation side and the driving side in the i-th rolling machine computed in the leveling control computation step satisfies the roll opening degree difference between the operation side and the driving side in the i-th rolling machine Fi by the above-described Expressions (1), (2), and (3) in the control section j, when the control section j is set when the tail end portion 10*a* of the traveling steel strip 10 is present between the j-th (j≤i−1) rolling machine Fj and the (j+1)th rolling machine Fj+1 counting from the rolling machine F1 installed on the most upstream side.

In the leveling control computation step, in the leveling control computing device 6, the control section in the control section i−1 in which the meandering amount measuring device 5 is installed is further divided into the control section i−1A when the tail end portion 10*a* of the traveling steel strip 10 is present between the (i−1)th rolling machine Fi−1 and the meandering amount measuring device 5, and the control section i−1B when the tail end portion 10*a* is present between the meandering amount measuring device 5 and the i-th rolling machine. The roll opening degree difference, which is the opening degree difference of the roll gaps between the operation side and the driving side in the i-th rolling machine computed by the leveling control computing device 6, satisfies the roll opening degree difference between the operation side and the driving side in the i-th rolling machine Fi by the above-described Expression (4) in the control section i−1A, and satisfies the roll opening degree difference between the operation side and the driving side in the i-th rolling machine Fi by the above-described Expression (5) in the control section i−1B.

Next, the process proceeds to step S4, and the leveling device 2 adjusts the rolling amount by the rolling device attached to the operation side of the rolling machine Fi which is the control target and the rolling amount by the rolling device attached to the driving side of the rolling machine Fi such that the roll opening degree difference of the rolling machine Fi which is the control target becomes the roll opening degree difference sent from the leveling control computing device 6, based on the roll opening degree difference sent from the leveling control computing device 6. Accordingly, the leveling amount of the rolling machine Fi which is the control target is changed to be proportional to the meandering amount of the steel strip 10 and the differential load of the rolling machine Fi (in the control section i−1B, only the differential load), and the meandering amount of the steel strip 10 is suppressed.

In the computation of the roll opening degree difference by the leveling control computation step, as illustrated in Expression (2), the control gain $\alpha_j$ with respect to the meandering amount measured by the meandering amount measuring device 5 in the control section j increases as the control section advances to the rear stage side, that is, as the tail end portion 10*a* of the steel strip 10 advances to the control section on the rear stage side. As illustrated in Expression (3), the control gain $\beta_j$ with respect to the differential load detected from the load detector 3 provided in the i-th rolling machine Fi in the control section j also increases as the control section advances to the rear stage side, that is, as the tail end portion 10*a* of the steel strip 10 advances to the control section on the rear stage side. Therefore, the control gains $\alpha_j$ and $\beta_j$ also increase in accordance with the tendency that the meandering increases as a tail end portion Sa of the steel strip 10 passes through the rolling machine on the rear stage side, and thus, it is possible to sufficiently suppress the meandering amount of the steel strip 10 during finish rolling.

Before the tail end portion 10*a* of the steel strip 10 passes through the meandering amount measuring device 5 (control section i−1A), the meandering of the steel strip 10 is controlled by using both the "meandering meter type meandering control" and the "differential load type meandering control" in combination, and the meandering amount and the differential load when passing through the (i−1)th rolling machine Fi−1 are set as control targets. Further, after the tail end portion 10*a* of the steel strip 10 has passed through the meandering amount measuring device 5 (control section i−1B), the meandering of the steel strip 10 is controlled only by the "differential load type meandering control," and the differential load when passing through the meandering amount measuring device 5 is set as the control target. Accordingly, the control target in the control section i−1B is switched from the differential load when passing through the (i−1)th rolling machine Fi−1 to the differential load when passing through the meandering amount measuring device 5, and accordingly, it is possible to further suppress the meandering amount of the steel strip 10.

Next, a modification example of the meandering amount measuring device 5 used in the meandering control device 4 illustrated in FIG. 1 will be described with reference to FIG. 3.

The meandering amount measuring device 5 described above is configured with the visible light camera (one-dimensional camera or two-dimensional camera), and measures the brightness distribution in the width direction of the steel strip 10 and calculates the meandering amount from the brightness distribution.

When the visible light camera is used as the meandering amount measuring device 5, and when the edges of both end portions of the steel strip 10 in the width direction are completely covered with steam, it may be difficult to measure the edge position.

Figure 3:
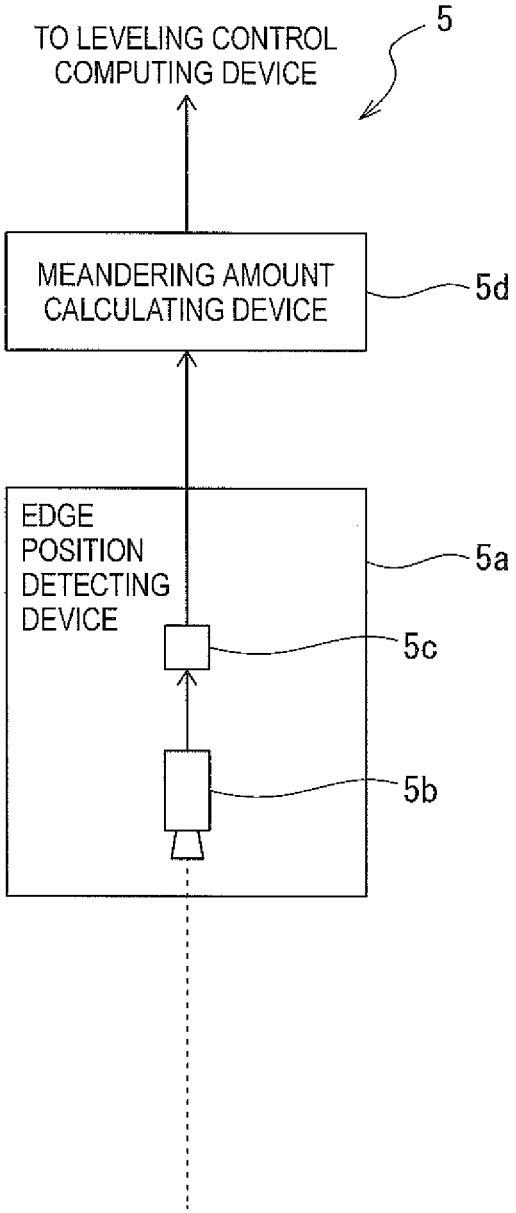
FIG. 3 is a schematic configuration view of a modification example of a meandering amount measuring device used in the meandering control device illustrated in FIG. 1.
Figure 4:
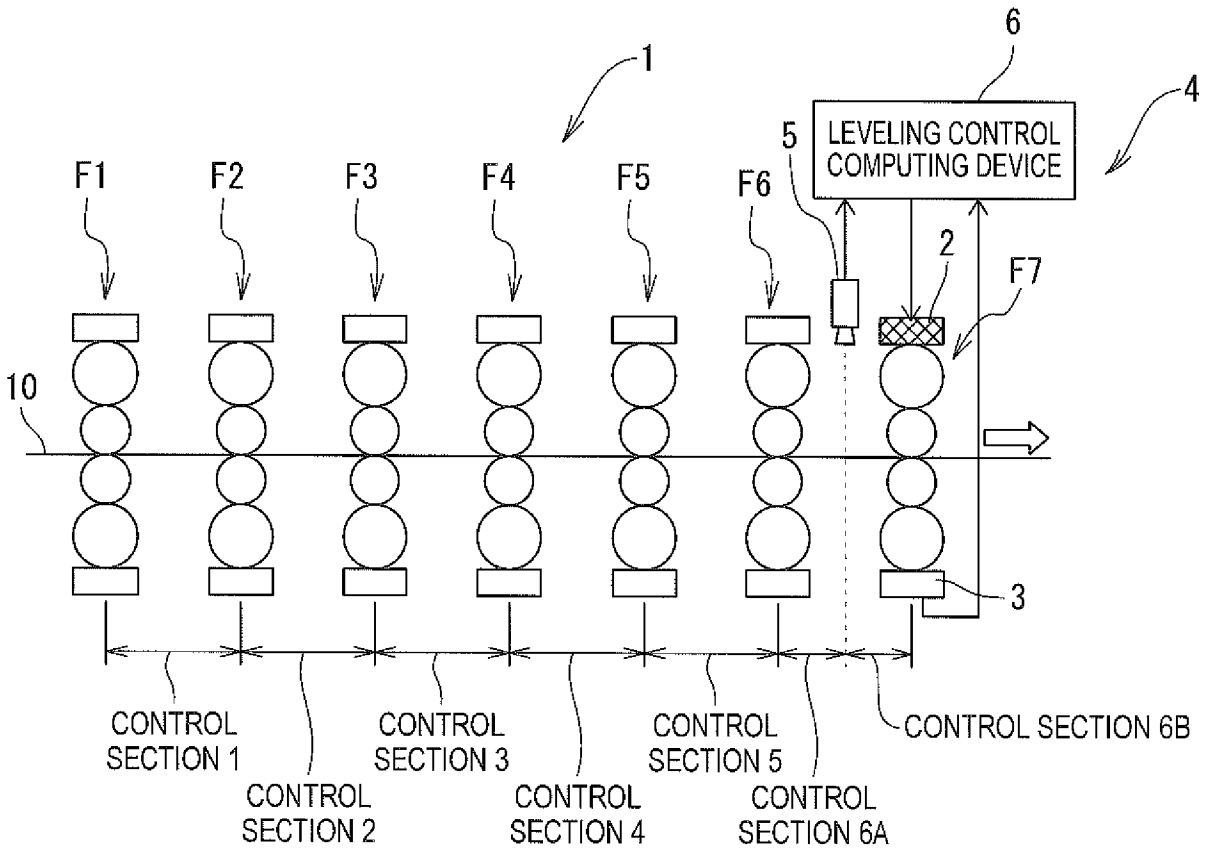
FIG. 4 is a schematic configuration view of the finish rolling equipment used in an example.

On the other hand, the meandering amount measuring device 5 illustrated in FIG. 3 includes an edge position detecting device 5*a* having an infrared camera 5*b* that images the intensity distribution of infrared rays emitted from the surface of the traveling steel strip 10, and an edge position detection unit 5*c* that detects the edge positions of both end portions of the steel strip 10 in the width direction from the intensity distribution of infrared rays imaged by the infrared camera 5*b*.

In this manner, according to the meandering amount measuring device 5 illustrated in FIG. 3, in the meandering amount measurement step, the intensity distribution of infrared rays emitted from the surface of the traveling steel strip 10 is imaged by the infrared camera 5*b* of the edge position detecting device 5*a*, and the edge positions of both end portions of the steel strip 10 in the width direction are detected by the edge position detection unit 5C of the edge position detecting device 5*a* from the intensity distribution of infrared rays imaged by the infrared camera 4.

Accordingly, even when the edges of both end portions of the steel strip 10 in the width direction are completely covered with steam, it is possible to appropriately and quickly image the intensity distribution of infrared rays, and to appropriately and quickly detect the edge positions of both end portions of the steel strip 10 in the width direction from the intensity distribution of infrared rays.

The meandering amount measuring device 5 illustrated in FIG. 3 includes a meandering amount calculating device 5*d* that calculates the meandering amount of the steel strip 10 based on the edge positions of both end portions of the steel strip 10 in the width direction detected by the edge position detecting device 5*a*.

According to the meandering amount measuring device 5 illustrated in FIG. 3, in the meandering amount measurement step, the meandering amount calculating device 5*d* calculates the position of the center of the steel strip 10 in the width direction from the detected edge positions of both end portions of the steel strip 10 in the width direction, and calculates the distance from the center of the rolling machines Fi−1 to Fi in the width direction to the calculated position of the center of the steel strip 10 in the width direction as the meandering amount of the steel strip 10.

Accordingly, even when the edges of both end portions of the steel strip 10 in the width direction are completely covered with steam, it is possible to appropriately and quickly calculate the meandering amount of the steel strip 10 based on the edge positions of both end portions of the steel strip 10 in the width direction, which are appropriately and quickly detected.

When calculating the meandering amount, that is, when measuring the meandering amount of the steel strip 10, measurement becomes possible at a high cycle with a measurement cycle of approximately 1 msec, and even when the time required for the steel strip 10 to pass through the rolling machines Fi−1 to Fi is less than 1 second, it becomes possible to perform leveling control automatically.

The wavelength used in the infrared camera 4 is preferably more than 1.5 μm and 1000 μm or less. When the wavelength of infrared rays is 1.5 μm or less or more than 1000 μm, it is not possible to obtain the high measurement accuracy intended by this disclosure, and it is not possible to appropriately and quickly detect the edge positions of both end portions of the steel strip 10 in the width direction. When the wavelength of infrared rays used in the infrared camera 4 is more than 1.5 μm and 1000 μm or less, it is possible to further increase the measurement accuracy as in the examples which will be described later. The wavelength used in the infrared camera 4 is more preferably 3.0 μm or more and 1000 μm or less.

Figure 2:
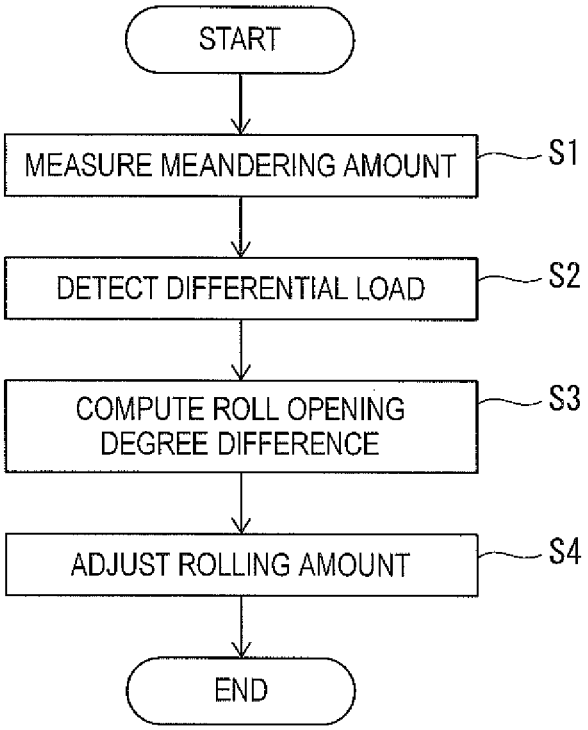
FIG. 2 is a flowchart illustrating a flow of a process by the meandering control device according to the example.

In the flow of the process of the meandering control device 4 including the meandering amount measuring device 5 illustrated in FIG. 3, similarly to the flowchart illustrated in FIG. 2, first, when the finish rolling of the steel strip 10 is started and the tip end portion of the steel strip 10 passes through the rolling machine Fi which is a control target, in step S1, the meandering amount measuring device 5 installed between the i-th (i≤n) rolling machine Fi and the (i−1)th rolling machine Fi−1 counting from the rolling machine F1 installed on the most upstream side measures the meandering amount of the traveling steel strip 10 (meandering amount measurement step).

Next, the process proceeds to step S2, and the leveling control computing device 6 detects the differential load between the operation side and the driving side from the rolling loads on the operation side and the driving side which are detected by the load detector 3 provided in the i-th rolling machine Fi, which is the control target (differential load detection step).

Next, the process proceeds to step S3, and the leveling control computing device 6 computes the roll opening degree difference, which is an opening degree difference of roll gaps between the operation side and the driving side in the i-th rolling machine Fi, based on the meandering amount of the steel strip 10 measured in step S1 (meandering amount measurement step) and the differential load detected in step S2 (differential load detection step), and sends the computed roll opening degree difference to the leveling device 2 provided in the i-th rolling machine Fi (leveling control computation step).

The roll opening degree difference which is the opening degree difference of the roll gaps between the operation side and the driving side in the i-th rolling machine computed in the leveling control computation step satisfies the roll opening degree difference between the operation side and the driving side in the i-th rolling machine Fi by the above-described Expressions (1), (2), and (3) in the control section j, when the control section j is set when the tail end portion 10*a* of the traveling steel strip 10 is present between the j-th (j≤i−1) rolling machine Fj and the (j+1)th rolling machine Fj+1 counting from the rolling machine F1 installed on the most upstream side.

In the leveling control computation step, in the leveling control computing device 6, the control section in the control section i−1 in which the meandering amount measuring device 5 is installed is further divided into the control section i−1A when the tail end portion 10*a* of the traveling steel strip 10 is present between the (i−1)th rolling machine Fi−1 and the meandering amount measuring device 5, and the control section i−1B when the tail end portion 10*a* is present between the meandering amount measuring device 5 and the i-th rolling machine. The roll opening degree difference, which is the opening degree difference of the roll gaps between the operation side and the driving side in the i-th rolling machine computed by the leveling control computing device 6, satisfies the roll opening degree difference between the operation side and the driving side in the i-th rolling machine Fi by the above-described Expression (4) in the control section i−1A, and satisfies the roll opening degree difference between the operation side and the driving side in the i-th rolling machine Fi by the above-described Expression (5) in the control section i−1B.

Next, the process proceeds to step S4, and the leveling device 2 adjusts the rolling amount by the rolling device attached to the operation side of the rolling machine Fi which is the control target and the rolling amount by the rolling device attached to the driving side of the rolling machine Fi such that the roll opening degree difference of the rolling machine Fi which is the control target becomes the roll opening degree difference sent from the leveling control computing device 6, based on the roll opening degree difference sent from the leveling control computing device 6. Accordingly, the leveling amount of the rolling machine Fi which is the control target is changed to be proportional to the meandering amount (in the control section i−1B, only the differential load) of the steel strip 10 and the differential load of the rolling machine Fi, and the meandering amount of the steel strip 10 is suppressed.

Although examples have been described above, this disclosure is not limited thereto, and various modifications and improvements are possible.

For example, the roll opening degree difference, which is the opening degree difference of the roll gaps between the operation side and the driving side in the i-th rolling machine computed by the leveling control computing device 6, may satisfy the roll opening degree difference between the operation side and the driving side in the i-th rolling machine Fi by Expression (6) in the control section i−1B:

$$S=\beta_{i-1B}D(\Delta P-\Delta P_{i-1})+S_{i-1B} \quad (6)$$

wherein S is the roll opening degree difference between the operation side and the driving side in the i-th rolling machine, $S_{i-1B}$ is the roll opening degree difference between the operation side and the driving side in the i-th rolling machine when the tail end portion 10*a* of the steel strip 10 has passed through the meandering amount measuring device 5, $\beta_{i-1B}$ is a control gain with respect to the differential load detected from the load detector 3 provided in the i-th rolling machine Fi, in the control section i−1B, $\Delta P_{i-1}$ is the differential load detected from the load detector 3 provided in the i-th rolling machine Fi when the tail end portion 10*a* of the steel strip 10 has passed through the (i−1) th rolling machine Fi−1, ΔP is the differential load detected from the load detector 3 provided in the i-th rolling machine Fi, in the control section i−1B, and D is a constant determined by a roll diameter, a roll length, the number of rolls, a width of a rolling material, and the like.

In other words, the control target in the control section i−1B may be the differential load when passing through the (i−1)th rolling machine Fi−1.

It is possible to appropriately change the parameters $\alpha_j$, C, $\delta_j$, $\beta_j$, D, $\Delta P_j$, and $S_j$ for determining the roll opening degree difference between the operation side and the driving side in the i-th rolling machine in Expressions (1), (2), and (3) as needed, and to add parameters other than these.

EXAMPLES

We finished-rolled the steel strip 10 using the finish rolling equipment 1 illustrated in FIG. 3, and measured the meandering amount of the steel strip 10 according to Comparative Example 1 and Examples 1 and 2. The width of the steel strip 10 was 1200 mm, the sheet thickness of the steel strip 10 on the entry side of the finish rolling equipment 1 was 28 mm, and the sheet thickness of the steel strip 10 on the exit side of the finish rolling equipment 1 was 1.8 mm. The rolling speed of the steel strip 10 on the exit side of the finish rolling equipment 1 was 120 mpm.

The finish rolling equipment 1 illustrated in FIG. 3 includes seven rolling machines F1 to F7, and the meandering amount measuring device 5 installed between the rolling machine F7 and the rolling machine F6 measured the meandering amount of the traveling steel strip 10. The leveling control computing device 6 detected the differential load between the operation side and the driving side from the rolling loads on the operation side and the driving side which are detected by the load detector 3 provided in the rolling machine F7.

In the Comparative Examples and Examples, C=0.01 and D=0.01 mm/tonf were satisfied in Expression (1).

In Comparative Example 1, the visible light camera was used as the meandering amount measuring device 5. The wavelength band was 0.4 to 0.7 μm.

In Comparative Example 1, when the tail end portion 10*a* of the traveling steel strip 10 is present in control sections 1 to 5, the leveling control computing device 6 did not perform the meandering control, did not compute the roll opening degree difference between the operation side and the driving side in the rolling machine F7, and did not adjust the rolling amount.

Then, when the tail end portion 10*a* is present in a control section 6A, while the control gain with respect to the meandering amount is 100%, the control gain with respect to the differential load is 100%, and the control target is the differential load which is detected from the load detector 3 provided in the rolling machine F7 when the tail end portion 10*a* has passed through the rolling machine F6, the roll opening degree difference between the operation side and the driving side in the rolling machine F7 was computed and the rolling amount was adjusted.

In other words, in Comparative Example 1, when the tail end portion 10*a* is present in the control section 6A, the roll opening degree difference between the operation side and the driving side in the rolling machine F7 was computed based on the expression of $S=1.0C(\delta-\delta_6)+1.0D(\Delta P-\Delta P_6)+S_6$, and the rolling amount was adjusted.

S is the roll opening degree difference between the operation side and the driving side in the rolling machine F7, $S_6$ is the roll opening degree difference between the operation side and the driving side in the rolling machine F7 when the tail end portion 10*a* of the steel strip 10 has passed through the rolling machine F6, $\delta_6$ is the meandering amount measured by the meandering amount measuring device 5 when the tail end portion 10*a* of the steel strip 10 has passed through the rolling machine F6, $\Delta P_6$ is the differential load detected from the load detector 3 provided in the rolling machine F7 when the tail end portion of the steel strip 10 has passed through the rolling machine F6, δ is the meandering amount measured by the meandering amount measuring device 5, in the control section 6A, and ΔP is the differential load detected from the load detector 3 provided in the rolling machine F7, in the control section 6A.

In Comparative Example 1, when the tail end portion 10*a* is present in a control section 6B, while the control gain with respect to the differential load is 100%, and the control target is the differential load which is detected from the load detector 3 provided in the rolling machine F7 when the tail end portion 10*a* has passed through the rolling machine F6, the roll opening degree difference between the operation side and the driving side in the rolling machine F7 was computed and the rolling amount was adjusted.

In other words, in Comparative Example 1, when the tail end portion Sa is present in the control section 6B, the roll opening degree difference between the operation side and the driving side in the rolling machine F7 was computed based on the expression of $S=1.0D(\Delta P-\Delta P_6)+S_{6B}$, and the rolling amount was adjusted.

S is the roll opening degree difference between the operation side and the driving side in the rolling machine F7, $S_{6B}$ is the roll opening degree difference between the operation side and the driving side in the rolling machine F7 when the tail end portion 10*a* of the steel strip 10 has passed through the meandering amount measuring device 5, $\Delta P_6$ is the differential load detected from the load detector 3 provided in the rolling machine F7 when the tail end portion 10*a* of the steel strip 10 has passed through the rolling machine F6, and ΔP is the differential load detected from the load detector 3 provided in the rolling machine F7, in the control section 6B.

In Example 1, the visible light camera was used as the meandering amount measuring device 5. The wavelength band was 0.4 to 0.7 μm.

Further, in Example 1, when the tail end portion 10*a* of the traveling steel strip 10 is present in the control section 1, while the control gain with respect to the meandering amount is 40% and the control gain with respect to the differential load is 40% in the control section 1, the leveling control computing device 6 computed the roll opening degree difference between the operation side and the driving side in the rolling machine F7 by the following expression and adjusted the rolling amount:

$$S=0.4C(\delta-\delta_1)+0.4D(\Delta P-\Delta P_1)+S_1.$$

S is the roll opening degree difference between the operation side and the driving side in the rolling machine F7, $S_1$ is the roll opening degree difference between the operation side and the driving side in the rolling machine F7 when the tail end portion 10*a* of the steel strip 10 has passed through the rolling machine F1, $\delta_1$ is the meandering amount measured by the meandering amount measuring device 5 when the tail end portion 10*a* of the steel strip 10 has passed through the rolling machine F1, $\Delta P_1$ is the differential load detected from the load detector 3 provided in the rolling machine F7 when the tail end portion 10*a* of the steel strip 10 has passed through the rolling machine F1, δ is the meandering amount measured by the meandering amount measuring device 5, in the control section 1, and ΔP is the differential load detected from the load detector 3 provided in the rolling machine F7, in the control section 1.

Further, in Example 1, when the tail end portion 10*a* of the traveling steel strip 10 is present in the control section 2, while the control gain with respect to the meandering amount is 50% and the control gain with respect to the differential load is 50% in the control section 2, the leveling control computing device 6 computed the roll opening degree difference between the operation side and the driving side in the rolling machine F7 by the following expression and adjusted the rolling amount:

$$S=0.5C(\delta-\delta_2)+0.5D(\Delta P-\Delta P_2)+S_2.$$

S is the roll opening degree difference between the operation side and the driving side in the rolling machine F7, S2 is the roll opening degree difference between the operation side and the driving side in the rolling machine F7 when the tail end portion 10*a* of the steel strip 10 has passed through the rolling machine F2, $\delta_2$ is the meandering amount measured by the meandering amount measuring device 5 when the tail end portion 10*a* of the steel strip 10 has passed through the rolling machine F2, $\Delta P_2$ is the differential load detected from the load detector 3 provided in the rolling machine F7 when the tail end portion 10*a* of the steel strip 10 has passed through the rolling machine F2, δ is the meandering amount measured by the meandering amount measuring device 5, in the control section 2, and ΔP is the differential load detected from the load detector 3 provided in the rolling machine F7, in the control section 2.

Further, in Example 1, when the tail end portion 10*a* of the traveling steel strip 10 is present in the control section 3, while the control gain with respect to the meandering amount is 60% and the control gain with respect to the differential load is 60% in the control section 3, the leveling control computing device 6 computed the roll opening degree difference between the operation side and the driving side in the rolling machine F7 by the following expression and adjusted the rolling amount:

$$S=0.6C(\delta-\delta_3)+0.6D(\Delta P-\Delta P_3)+S_3.$$

S is the roll opening degree difference between the operation side and the driving side in the rolling machine F7, $S_3$ is the roll opening degree difference between the operation side and the driving side in the rolling machine F7 when the tail end portion 10*a* of the steel strip 10 has passed through the rolling machine F3, $\delta_3$ is the meandering amount measured by the meandering amount measuring device 5 when the tail end portion 10*a* of the steel strip 10 has passed through the rolling machine F3, $\Delta P_3$ is the differential load detected from the load detector 3 provided in the rolling machine F7 when the tail end portion 10*a* of the steel strip 10 has passed through the rolling machine F3, δ is the meandering amount measured by the meandering amount measuring device 5, in the control section 3, and ΔP is the differential load detected from the load detector 3 provided in the rolling machine F7, in the control section 3.

Further, in Example 1, when the tail end portion 10*a* of the traveling steel strip 10 is present in the control section 4, while the control gain with respect to the meandering amount is 70% and the control gain with respect to the differential load is 70% in the control section 4, the leveling control computing device 6 computed the roll opening degree difference between the operation side and the driving side in the rolling machine F7 by the following expression and adjusted the rolling amount:

$$S=0.7C(\delta-\delta_4)+0.7D(\Delta P-\Delta P_4)+S_4.$$

S is the roll opening degree difference between the operation side and the driving side in the rolling machine F7, $S_4$ is the roll opening degree difference between the operation side and the driving side in the rolling machine F7 when the tail end portion 10*a* of the steel strip 10 has passed through the rolling machine F4, $\delta_4$ is the meandering amount measured by the meandering amount measuring device 5 when the tail end portion 10*a* of the steel strip 10 has passed through the rolling machine F4, $\Delta P_4$ is the differential load detected from the load detector 3 provided in the rolling machine F7 when the tail end portion 10*a* of the steel strip 10 has passed through the rolling machine F4, δ is the meandering amount measured by the meandering amount measuring device 5, in the control section 4, and ΔP is the differential load detected from the load detector 3 provided in the rolling machine F7, in the control section 4.

Further, in Example 1, when the tail end portion 10*a* of the traveling steel strip 10 is present in the control section 5, while the control gain with respect to the meandering amount is 80% and the control gain with respect to the differential load is 80% in the control section 5, the leveling control computing device 6 computed the roll opening degree difference between the operation side and the driving side in the rolling machine F7 by the following expression and adjusted the rolling amount:

$$S=0.8C(\delta-\delta_5)+0.8D(\Delta P-\Delta P_5)+S_5.$$

S is the roll opening degree difference between the operation side and the driving side in the rolling machine F7, $S_5$ is the roll opening degree difference between the operation side and the driving side in the rolling machine F7 when the tail end portion 10*a* of the steel strip 10 has passed through the rolling machine F5, $\delta_5$ is the meandering amount measured by the meandering amount measuring device 5 when the tail end portion 10*a* of the steel strip 10 has passed through the rolling machine F5, $\Delta P_5$ is the differential load detected from the load detector 3 provided in the rolling machine F7 when the tail end portion 10*a* of the steel strip 10 has passed through the rolling machine F5, δ is the meandering amount measured by the meandering amount measuring device 5, in the control section 5, and ΔP is the differential load detected from the load detector 3 provided in the rolling machine F7, in the control section 5.

In Example 1, when the tail end portion Sa of the traveling steel strip 10 is present in the control section 6A, while the control gain with respect to the meandering amount is 100%, the control gain with respect to the differential load is 100%, and the control target is the differential load which is detected from the load detector 3 provided in the rolling machine F7 when the tail end portion 10*a* has passed through the rolling machine F6 in the control section 6A, the leveling control computing device 6 computed the roll opening degree difference between the operation side and the driving side in the rolling machine F7 by the following expression and adjusted the rolling amount:

$$S=1.0C(\delta-\delta_6)+1.0D(\Delta P-\Delta P_6)+S_6.$$

S is the roll opening degree difference between the operation side and the driving side in the rolling machine F7, $S_6$ is the roll opening degree difference between the operation side and the driving side in the rolling machine F7 when the tail end portion 10*a* of the steel strip 10 has passed through the rolling machine F6, 6δ is the meandering amount measured by the meandering amount measuring device 5 when the tail end portion 10*a* of the steel strip 10 has passed through the rolling machine F6, $\Delta P_6$ is the differential load detected from the load detector 3 provided in the rolling machine F7 when the tail end portion 10*a* of the steel strip 10 has passed through the rolling machine F6, δ is the meandering amount measured by the meandering amount measuring device 5, in the control section 6A, and ΔP is the differential load detected from the load detector 3 provided in the rolling machine F7, in the control section 6A.

In Example 1, when the tail end portion 10*a* is present in the control section 6B, while the control gain with respect to the differential load is 100%, and the control target is the differential load which is detected from the load detector 3 provided in the rolling machine F7 when the tail end portion 10*a* has passed through the rolling machine F6, the leveling control computing device 6 computed the roll opening degree difference between the operation side and the driving side in the rolling machine F7 by the following expression and adjusted the rolling amount:

$$S=1.0D(\Delta P-\Delta P_6)+S_{6B}.$$

S is the roll opening degree difference between the operation side and the driving side in the rolling machine F7, $S_{6B}$ is the roll opening degree difference between the operation side and the driving side in the rolling machine F7 when the tail end portion 10*a* of the steel strip 10 has passed through the meandering amount measuring device 5, $\Delta P_6$ is the differential load detected from the load detector 3 provided in the rolling machine F7 when the tail end portion 10*a* of the steel strip 10 has passed through the rolling machine F6, and ΔP is the differential load detected from the load detector 3 provided in the rolling machine F7, in the control section 6B.

In Example 2, the visible light camera was used as the meandering amount measuring device 5. The wavelength band was 0.4 to 0.7 μm.

Further, in Example 2, when the tail end portion 10*a* of the traveling steel strip 10 is present in the control sections 1 to 6A, in the control sections 1 to 6A, the leveling control computing device 6 computed the roll opening degree difference between the operation side and the driving side in the rolling machine F7 by the similar expression as that in Example 1 and adjusted the rolling amount.

In Example 2, when the tail end portion 10*a* is present in the control section 6B, while the control gain with respect to the differential load is 100%, and the control target is the differential load which is detected from the load detector 3 provided in the rolling machine F7 when the tail end portion 10*a* has passed through the meandering amount measuring device 5, the leveling control computing device 6 computed the roll opening degree difference between the operation side and the driving side in the rolling machine F7 by the following expression and adjusted the rolling amount:

$$S=1.0D(\Delta P-\Delta P_{6B})+S_{6B}.$$

S is the roll opening degree difference between the operation side and the driving side in the rolling machine F7, $S_{6B}$ is the roll opening degree difference between the operation side and the driving side in the rolling machine F7 when the tail end portion 10*a* of the steel strip 10 has passed through the meandering amount measuring device 5, $\Delta P_{6B}$ is the differential load detected from the load detector 3 provided in the rolling machine F7 when the tail end portion 10*a* of the steel strip 10 has passed through the meandering amount measuring device 5, and ΔP is the differential load detected from the load detector 3 provided in the rolling machine F7, in the control section 6B.

In other words, in Example 2, the control target in the control section 6B was switched from the differential load when passing through the rolling machine F6 to the differential load when passing through the meandering amount measuring device 5.

In Example 3, the infrared camera was used as the meandering amount measuring device 5. The wavelength band was 8 to 14 μm.

Further, the gain setting method and the rolling amount adjustment method in Example 3 were the same as those in Example 2.

Table 1 illustrates the meandering control conditions and the meandering control results of Comparative Example 1 and Examples 1 and 2.

TABLE 1

| | Camera | Wavelength | Control targets passing through F6 and F7 | | Control gain (meandering amount) | | | | | | | Control gain (differential load) | | | | | | | Meandering |
|---|---|---|---|---|---|---|---|---|---|---|---|---|---|---|---|---|---|---|---|
| | type | band | 6A | 6B | 1 | 2 | 3 | 4 | 5 | 6A | 6B | 1 | 2 | 3 | 4 | 5 | 6A | 6B | amount |
| | — | μm | — | — | — | — | — | — | — | — | — | — | — | — | — | — | — | — | mm |
| Comparative Example 1 | Visible light camera | 0.4 to 0.7 | Differential load when passing through F6 | Differential load when passing through F6 | X | X | X | X | X | 100 | X | X | X | X | X | X | 100 | 100 | 96 |
| Example 1 | Visible light camera | 0.4 to 0.7 | Differential load when passing through F6 | Differential load when passing through F6 | 40 | 50 | 60 | 70 | 80 | 100 | X | 40 | 50 | 60 | 70 | 80 | 100 | 100 | 52 |
| Example 2 | Visible light camera | 0.4 to 0.7 | Differential load when passing through F6 | Differential load when passing through meandering amount measuring device | 40 | 50 | 60 | 70 | 80 | 100 | X | 40 | 50 | 60 | 70 | 80 | 100 | 100 | 34 |

TABLE 1-continued

| | Camera | Wavelength | Control targets passing through F6 and F7 | | Control gain (meandering amount) | | | | | | | Control gain (differential load) | | | | | | | Meandering |
|---|---|---|---|---|---|---|---|---|---|---|---|---|---|---|---|---|---|---|---|
| | type | band | 6A | 6B | 1 | 2 | 3 | 4 | 5 | 6A | 6B | 1 | 2 | 3 | 4 | 5 | 6A | 6B | amount |
| | — | μm | — | — | — | — | — | — | — | — | — | — | — | — | — | — | — | — | mm |
| Example 3 | Infrared camera | 8.0 to 14.0 | Differential load when passing through F6 | Differential load when passing through meandering amount measuring device | 40 | 50 | 60 | 70 | 80 | 100 | X | 40 | 50 | 60 | 70 | 80 | 100 | 100 | 21 |

In Comparative Example 1, as a result of measuring the meandering amount of the tail end portion 10*a* of the steel strip 10 with a camera installed between the rolling machine F6 and the rolling machine F7, the meandering amount was 96 mm.

In Example 1, as a result of measuring the meandering amount of the tail end portion 10*a* of the steel strip 10 with a camera installed between the rolling machine F6 and the rolling machine F7, the meandering amount was 72 mm, and it was confirmed that it was possible to reduce the meandering amount of the tail end portion 10*a* of the steel strip 10 compared to Comparative Example 1.

In Example 2, as a result of measuring the meandering amount of the tail end portion 10*a* of the steel strip 10 with a camera installed between the rolling machine F6 and the rolling machine F7, the meandering amount was 34 mm, and it was confirmed that it was possible to reduce the meandering amount of the tail end portion 10*a* of the steel strip 10 compared to Comparative Example 1 and Example 1.

In Example 3, as a result of measuring the meandering amount of the tail end portion 10*a* of the steel strip 10 with a camera installed between the rolling machine F6 and the rolling machine F7, the meandering amount was 21 mm, and it was confirmed that it was possible to reduce the meandering amount of the tail end portion 10*a* of the steel strip 10 compared to Comparative Example 1 and Example 2.

As described in Examples 1, 2, and 3, by increasing the control gain $\alpha_j$ with respect to the meandering amount measured by the meandering amount measuring device 5 in the control section j, and the control gain $\beta_j$ with respect to the differential load, which is detected from the load detector 3 provided in the i-th rolling machine Fi, in the control section j as the tail end portion 10*a* of the steel strip 10 advances to the control section on the rear stage side, an effect of suppressing the meandering phenomenon is achieved.

The invention claimed is:

1. A meandering control method for a hot-rolled steel strip, the method controlling meandering of the hot-rolled steel strip rolled in finish rolling equipment including n (n≥3) rolling machines each of the rolling machines having a load detector configured to detect rolling loads on an operation side and a driving side and a leveling device configured to adjust rolling amounts on the operation side and the driving side, the method comprising:

a meandering amount measurement step of measuring a meandering amount of a traveling hot-rolled steel strip by a meandering amount measuring device installed between an i-th (i≥n) rolling machine and an (i−1)th rolling machine counting from a rolling machine installed on a most upstream side;

a differential load detection step of detecting a differential load between the operation side and the driving side from the rolling loads on the operation side and the driving side detected by the load detector provided in the i-th rolling machine; and a leveling control computation step of computing a roll opening degree difference based on the meandering amount of the hot-rolled steel strip measured in the meandering amount measurement step and the differential load detected in the differential load detection step, the roll opening degree difference being an opening degree difference of roll gaps between the operation side and the driving side in the i-th rolling machine, and sending the computed roll opening degree difference to the leveling device provided in the i-th rolling machine, wherein the roll opening degree difference computed in the leveling control computation step, the roll opening degree difference being the opening degree difference of the roll gaps between the operation side and the driving side in the i-th rolling machine, satisfies the roll opening degree difference between the operation side and the driving side in the i-th rolling machine by Expressions (1), (2), and (3) in a control section j, when the control section j is set when a tail end portion of the traveling hot-rolled steel strip is present between a j-th (j≤i−1) rolling machine and a (j+1)th rolling machine counting from the rolling machine installed on the most upstream side, $$S=\alpha_j C(\delta-\delta_j)+\beta_j D(\Delta P-\Delta P_j)+S_j \quad (1)$$

$$0\leq\alpha_1\leq\alpha_2\leq \ldots \leq\alpha_j\leq \ldots \leq\alpha_{i-1} \quad (2)$$

$$0\leq\beta_1\leq\beta_2\leq \ldots \leq\beta_j\leq \ldots \leq\beta_{i-1} \quad (3)$$

wherein S is the roll opening degree difference between the operation side and the driving side in the i-th rolling machine, $S_j$ is the roll opening degree difference between the operation side and the driving side in the i-th rolling machine when the tail end portion of the hot-rolled steel strip has passed through the j-th rolling machine, $\alpha_j$ is a control gain with respect to the meandering amount measured by the meandering amount measuring device, in the control section j, $\beta_j$ is a control gain with respect to the differential load detected from the load detector provided in the i-th rolling machine, in the control section j, $\delta_j$ is the meandering amount measured by the meandering amount measuring device when the tail end portion of the hot-rolled steel strip has passed through the j-th rolling machine, $\delta P_j$ is the differential load detected from the load detector provided in the i-th rolling machine when the tail end portion of the hot-rolled steel strip has passed through the j-th rolling machine, δ is the meandering amount measured by the meandering amount measuring device, in the control section j, ΔP is the differential load detected from the load detector provided in the i-th rolling machine, in the control section j, C is a change amount of a leveling amount with respect to the meandering amount, and D is a constant determined by a roll diameter, a roll length, number of rolls or a width of a rolling material.

2. The method according to claim 1, wherein the roll opening degree difference computed in the leveling control computation step, the roll opening degree difference being the opening degree difference of the roll gaps between the operation side and the driving side in the i-th rolling machine, satisfies the roll opening degree difference between the operation side and the driving side in the i-th rolling machine by Expression (4) in a control section i−1A, and satisfies the roll opening degree difference between the operation side and the driving side in the i-th rolling machine by Expression (5) in a control section i−1B, when the control section in a control section i−1 in which the meandering amount measuring device is installed is further divided into the control section i−1A when the tail end portion of the traveling hot-rolled steel strip is present between the (i−1)th rolling machine and the meandering amount measuring device, and the control section i−1B when the tail end portion is present between the meandering amount measuring device and the i-th rolling machine, $$S=\alpha_{1-1A}(\delta-\delta_{i-1})+\beta_{i-1A}D(\Delta P-\Delta P_{i-i})+S_{i-1} \quad (4)$$

wherein S is the roll opening degree difference between the operation side and the driving side in the i-th rolling machine, $S_{i-1}$ is the roll opening degree difference between the operation side and the driving side in the i-th rolling machine when the tail end portion of the hot-rolled steel strip has passed through the (i−1)th rolling machine, $\alpha_{i-1}A$ is a control gain with respect to the meandering amount measured by the meandering amount measuring device, in the control section i−1A, $\beta_{i-1A}$ is a control gain with respect to the differential load detected from the load detector provided in the i-th rolling machine, in the control section i−1A, $\delta_{i-1}$ is the meandering amount measured by the meandering amount measuring device when the tail end portion of the hot-rolled steel strip has passed through the (i−1)th rolling machine, $\Delta P_{i-1}$ is the differential load detected from the load detector provided in the i-th rolling machine when the tail end portion of the hot-rolled steel strip has passed through the (i−1)th rolling machine, δ is the meandering amount measured by the meandering amount measuring device, in the control section i−1A, ΔP is the differential load detected from the load detector provided in the i-th rolling machine, in the control section i−1A, $$S=\beta_{i-B}D(\Delta P-\Delta P_{i-1B})+S_{i-1B} \quad (5)$$

wherein S is the roll opening degree difference between the operation side and the driving side in the i-th rolling machine, $S_{i-1B}$ is the roll opening degree difference between the operation side and the driving side in the i-th rolling machine when the tail end portion of the hot-rolled steel strip has passed through the meandering amount measuring device, $\beta_{i-1B}$ is a control gain with respect to the differential load detected from the load detector provided in the i-th rolling machine, in the control section i−1B, $\Delta P_{i-1B}$ is the differential load detected from the load detector provided in the i-th rolling machine when the tail end portion of the hot-rolled steel strip has passed through the meandering amount measuring device, ΔP is the differential load detected from the load detector provided in the i-th rolling machine, in the control section i−1B.

3. The method according to claim 2, wherein the meandering amount measuring device used in the meandering amount measurement step includes an edge position detecting device having an infrared camera configured to image intensity distribution of infrared rays emitted from a surface of the traveling hot-rolled steel strip and an edge position detection unit configured to detect edge positions of both end portions of the hot-rolled steel strip in a width direction from the intensity distribution of infrared rays imaged by the infrared camera, and a meandering amount calculating device configured to calculate the meandering amount of the hot-rolled steel strip based on the edge positions of the both end portions of the hot-rolled steel strip in the width direction detected by the edge position detecting device.

4. The method according to claim 3, wherein a wavelength of infrared rays used in the infrared camera is 1.5 μm to 1000 μm.

5. The method according to claim 1, wherein the meandering amount measuring device used in the meandering amount measurement step includes an edge position detecting device having an infrared camera configured to image intensity distribution of infrared rays emitted from a surface of the traveling hot-rolled steel strip and an edge position detection unit configured to detect edge positions of both end portions of the hot-rolled steel strip in a width direction from the intensity distribution of infrared rays imaged by the infrared camera, and a meandering amount calculating device configured to calculate the meandering amount of the hot-rolled steel strip based on the edge positions of the both end portions of the hot-rolled steel strip in the width direction detected by the edge position detecting device.

6. The method according to claim 5, wherein a wavelength of infrared rays used in the infrared camera is 1.5 μm to 1000 μm.

7. A meandering control device for a hot-rolled steel strip, the device being configured to control meandering of the hot-rolled steel strip rolled in finish rolling equipment including n (n≥3) rolling machines each of the rolling machines having a load detector configured to detect rolling loads on an operation side and a driving side and a leveling device configured to adjust rolling amounts on the operation side and the driving side, the device comprising:

a meandering amount measuring device installed between an i-th (i≤n) rolling machine and an (i−1)th rolling machine counting from a rolling machine installed on a most upstream side, and configured to measure a meandering amount of a traveling hot-rolled steel strip; and a leveling control computing device configured to compute a roll opening degree difference based on the meandering amount of the hot-rolled steel strip measured by the meandering amount measuring device and a differential load between the operation side and the driving side detected from the rolling loads on the operation side and the driving side detected by the load detector provided in the i-th rolling machine, the roll opening degree difference being an opening degree difference of roll gaps between the operation side and the driving side in the i-th rolling machine, and to send the computed roll opening degree difference to the leveling device provided in the i-th rolling machine, wherein the roll opening degree difference computed by the leveling control computing device, the roll opening degree difference being the opening degree difference of the roll gaps between the operation side and the driving side in the i-th rolling machine, satisfies the roll opening degree difference between the operation side and the driving side in the i-th rolling machine by Expressions (1), (2), and (3) in a control section j, in a case where the control section j is set when a tail end portion of the traveling hot-rolled steel strip is present between a j-th ($j \le i-1$) rolling machine and a (j+1)th rolling machine counting from the rolling machine installed on the most upstream side, $$S=\alpha_j C(\delta-\delta_j)+\beta_j D(\Delta P-\Delta P_j)+S_j \quad (1)$$

$$0 \le \alpha_1 \le \alpha_2 \le \ldots \le \alpha_j \le \ldots \le \alpha_{i-1} \quad (2)$$

$$0 \le \beta_1 \le \beta_2 \le \ldots \le \beta_j \le \ldots \le \beta_{i-1} \quad (3)$$

wherein S is the roll opening degree difference between the operation side and the driving side in the i-th rolling machine, $S_j$ is the roll opening degree difference between the operation side and the driving side in the i-th rolling machine when the tail end portion of the hot-rolled steel strip has passed through the j-th rolling machine, $\alpha_j$ is a control gain with respect to the meandering amount measured by the meandering amount measuring device, in the control section j, $\beta_j$ is a control gain with respect to the differential load detected from the load detector provided in the i-th rolling machine, in the control section j, $\delta_j$ is the meandering amount measured by the meandering amount measuring device when the tail end portion of the hot-rolled steel strip has passed through the j-th rolling machine, $\Delta P_j$ is the differential load detected from the load detector provided in the i-th rolling machine when the tail end portion of the hot-rolled steel strip has passed through the j-th rolling machine, $\delta$ is the meandering amount measured by the meandering amount measuring device, in the control section j, $\Delta P$ is the differential load detected from the load detector provided in the i-th rolling machine, in the control section j, C is a change amount of a leveling amount with respect to the meandering amount, and D is a constant determined by a roll diameter, a roll length, the number of rolls, a width of a rolling material.

8. The device according to claim 7, wherein the roll opening degree difference computed by the leveling control computing device, the roll opening degree difference being the opening degree difference of the roll gaps between the operation side and the driving side in the i-th rolling machine, satisfies the roll opening degree difference between the operation side and the driving side in the i-th rolling machine by Expression (4) in a control section i−1A, and satisfies the roll opening degree difference between the operation side and the driving side in the i-th rolling machine by Expression (5) in a control section i−1B, when the control section in a control section i−1 in which the meandering amount measuring device is installed is further divided into the control section i−1A when the tail end portion of the traveling hot-rolled steel strip is present between the (i−1)th rolling machine and the meandering amount measuring device, and the control section i−1B when the tail end portion is present between the meandering amount measuring device and the i-th rolling machine, $$S=\alpha_{1-1A}(\delta-\delta_{i-1})+\beta_{i-1A}D(\Delta P-\Delta P_{i-i})+S_{i-1} \quad (4)$$

wherein S is the roll opening degree difference between the operation side and the driving side in the i-th rolling machine, $S_{i-1}$ is the roll opening degree difference between the operation side and the driving side in the i-th rolling machine when the tail end portion of the hot-rolled steel strip has passed through the (i−1)th rolling machine, $\alpha_{i-1}A$ is a control gain with respect to the meandering amount measured by the meandering amount measuring device, in the control section i−1A, $\beta_{i-1\ A}$ is a control gain with respect to the differential load detected from the load detector provided in the i-th rolling machine, in the control section i−1A, $\delta_{i-1}$ is the meandering amount measured by the meandering amount measuring device when the tail end portion of the hot-rolled steel strip has passed through the (i−1)th rolling machine, $\Delta P_{i-1}$ is the differential load detected from the load detector provided in the i-th rolling machine when the tail end portion of the hot-rolled steel strip has passed through the (i−1)th rolling machine, $\delta$ is the meandering amount measured by the meandering amount measuring device, in the control section i−1A, $\Delta P$ is the differential load detected from the load detector provided in the i-th rolling machine, in the control section i−1A, $$S=\beta_{i-B}D(\Delta P-\Delta P_{i-1B})+S_{i-1B} \quad (5)$$

wherein S is the roll opening degree difference between the operation side and the driving side in the i-th rolling machine, $S_{i-1B}$ is the roll opening degree difference between the operation side and the driving side in the i-th rolling machine when the tail end portion of the hot-rolled steel strip has passed through the meandering amount measuring device, $\beta_{i-1B}$ is a control gain with respect to the differential load detected from the load detector provided in the i-th rolling machine, in the control section i−1B, $\Delta P_{i-1B}$ is the differential load detected from the load detector provided in the i-th rolling machine when the tail end portion of the hot-rolled steel strip has passed through the meandering amount measuring device, $\Delta P$ is the differential load detected from the load detector provided in the i-th rolling machine, in the control section i−1B.

9. The device according to claim 8, wherein the meandering amount measuring device includes an edge position detecting device having an infrared camera configured to image intensity distribution of infrared rays emitted from a surface of the traveling hot-rolled steel strip and an edge position detection unit configured to detect edge positions of both end portions of the hot-rolled steel strip in a width direction from the intensity distribution of infrared rays imaged by the infrared camera, and a meandering amount calculating device configured to calculate the meandering amount of the hot-rolled steel strip based on the edge positions of the both end portions of the hot-rolled steel strip in the width direction detected by the edge position detecting device.

10. The device according to claim 9, wherein a wavelength of infrared rays used in the infrared camera is 1.5 μm to 1000 μm.

11. Hot rolling equipment comprising:
the device according to claim 10.

12. Hot rolling equipment comprising:
the device according to claim 9.

13. Hot rolling equipment comprising:
the device according to claim 8.

14. The device according to claim 7, wherein the meandering amount measuring device includes an edge position detecting device having an infrared camera configured to image intensity distribution of infrared rays emitted from a surface of the traveling hot-rolled steel strip and an edge position detection unit configured to detect edge positions of both end portions of the hot-rolled steel strip in a width direction from the intensity distribution of infrared rays imaged by the infrared camera, and a meandering amount calculating device configured to calculate the meandering amount of the hot-rolled steel strip based on the edge positions of the both end portions of the hot-rolled steel strip in the width direction detected by the edge position detecting device.

15. The device according to claim 14, wherein a wavelength of infrared rays used in the infrared camera is 1.5 μm to 1000 μm.

16. Hot rolling equipment comprising:
the device according to claim 15.

17. Hot rolling equipment comprising:
the device according to claim 14.

18. Hot rolling equipment comprising:
the device according to claim 7.

* * * * *